US010206838B2

(12) United States Patent
Wakabayashi et al.

(10) Patent No.: US 10,206,838 B2
(45) Date of Patent: Feb. 19, 2019

(54) INCUBATOR

(71) Applicant: ATOM MEDICAL CORPORATION, Bunkyo-ku, Tokyo (JP)

(72) Inventors: Keisuke Wakabayashi, Saitama (JP); Kenji Kobayashi, Saitama (JP); Masaaki Oohashi, Saitama (JP); Ichiro Matsubara, Tokyo (JP); Terumi Matsubara, Tokyo (JP)

(73) Assignee: ATOM MEDICAL CORPORATION, Tokyo (JP)

( * ) Notice: Subject to any disclaimer, the term of this patent is extended or adjusted under 35 U.S.C. 154(b) by 84 days.

(21) Appl. No.: 15/341,505

(22) Filed: Nov. 2, 2016

(65) Prior Publication Data

US 2017/0128301 A1 May 11, 2017

(30) Foreign Application Priority Data

Nov. 6, 2015 (JP) ..... 2015-218299

(51) Int. Cl.
*A61G 11/00* (2006.01)

(52) U.S. Cl.
CPC ..... *A61G 11/005* (2013.01); *A61G 11/006* (2013.01); *A61G 11/009* (2013.01); *A61G 11/002* (2013.01)

(58) Field of Classification Search
CPC .... A61G 11/00; A61G 11/005; A61G 11/006; A61G 11/007
USPC ..... 600/21–22
See application file for complete search history.

(56) References Cited

U.S. PATENT DOCUMENTS 3,705,576 A * 12/1972 Roth ..... A61G 11/00 250/494.1
4,936,824 A * 6/1990 Koch ..... A61G 11/00 128/205.26

FOREIGN PATENT DOCUMENTS

| | | | |
|---|---|---|---|
| CN | 101883552 | A | 11/2010 |
| EP | 2 556 814 | A1 | 2/2013 |
| JP | H09-276343 | A | 10/1997 |

OTHER PUBLICATIONS

Extended Search Report in corresponding European Application No. 16196918.3, dated Mar. 21, 2017, 7 pages.
Office Action in China application No. 201610961808.5, including partial English Translation, dated Nov. 22, 2018, pp. 1-8.

* cited by examiner

*Primary Examiner* — John Lacyk
(74) *Attorney, Agent, or Firm* — Brinks Gilson & Lione

(57) ABSTRACT

An incubator of the disclosure is configured such that a top hood is detachable from a peripheral frame by unlatching first latch mechanisms that latch the top hood. The incubator is also configured such that any of wall portion among four wall portions configuring the peripheral frame are detachable from an incubator base by unlatching any of corresponding second to fifth latch mechanisms.

8 Claims, 12 Drawing Sheets

INCUBATOR

RELATED APPLICATIONS

This application claims priority under 35 U.S.C. § 119 to Japanese Patent Application No. 2015-218299 filed on Nov. 6, 2015, the entire content of which is hereby incorporated by reference.

BACKGROUND OF THE INVENTION

1. Field of the Invention

The present disclosure relates to an incubator equipped with an incubator base that is capable of supporting a bed base, a peripheral frame configured by first, second, third, and fourth wall portions attached to the incubator base in order to form an outer periphery of an infant accommodation space, and a top hood attached to at least one wall portion of the first to fourth wall portions in order to form an upper surface of the infant accommodation space.

2. Description of the Related Art

Incubators have conventionally been known as exemplified in Japanese Patent Application Laid-open (JP-A) No. H09-276343. In the incubator disclosed in JP-A No. H09-276343, an operator such as a doctor or nurse may administer various types of care as follows to an infant such as a newborn infant lying on the bed base disposed in the infant accommodation space in the incubator. Namely, the operator such as a doctor or nurse causes a movable wall portion configuring a front surface of an enclosure to be substantially a hanged-down state by swinging forth the movable wall portion outwardly from a substantially upright state (in other words, a closed state) using the vicinity of the lower end portion of the movable wall portion as a pivot point. Therefore, since the infant accommodation space is opened at its front surface, the operator such as a doctor or nurse may move closer to the infant from the opened front surface and then easily and quickly administer the necessary care to the infant. Furthermore, after administering the care, the operator may reclose the infant accommodation space by swinging back the substantially hanged-down movable wall portion in the opposite direction to the direction in which the movable wall portion has been swung forth.

However, in the incubator of JP-A No. H09-276343, the enclosure is disposed on top of the incubator base in order to form the infant accommodation space. In the enclosure, the wall portions other than the movable wall portion formed on the front surface of the enclosure (that is, the section of the front wall portion other than the movable wall portion, the rear wall portion, the left and right wall portions, and the top hood portion) and the incubator base are sequentially integrally connected to each other by adhering them to each other with an adhesive, for example, so that they cannot be easily separated. Therefore, when more than one of this incubator are simultaneously transported by transporting means such as a cargo ship, a freight train, or a truck, the per-unit cost of transporting the closed type incubators becomes relatively high because each of the closed type incubators is relative bulky.

Additionally, in this incubator, the mutual connections between the front, rear, and left and right wall portions, the top hood portion, and the incubator base cannot be separated. Therefore, if the body fluid or the like of an infant sticks to an adjacent section between the wall portions, and/or an adjacent section between the wall portions and the top hood portion, and/or an adjacent section between the incubator base and the wall portions (particularly, a gap therebetween), it is relatively difficult to thoroughly clean that section by wiping it down. Thus, when another infant is accommodated in the infant accommodation space in the incubator, since it is relatively difficult to thoroughly clean the gap or the like beforehand, there is the potential for the body fluid or the like to remain in the gap or the like and, as a result, the potential for the other infant to become infected becomes higher.

Furthermore, in this incubator, the connections between the front, rear, and left and right wall portions, the top hood portion, and the incubator base cannot be separated from each other. Therefore, when at least one of the wall portions or the top hood portion is partially or completely damaged, it is necessary to replace the entire combined structure of the enclosure and the incubator base configured by the four wall portions, the top hood portion, and the incubator base.

SUMMARY OF THE INVENTION

The present disclosure has been made in order to effectively address, with a relatively simple configuration, the aforementioned shortcomings in the conventional incubators.

An aspect of the present disclosure is an incubator including: an incubator base that is configured to support a bed base; a peripheral frame that includes a first wall portion, a second wall portion, a third wall portion, and a fourth wall portion that are attached to the incubator base and form an outer periphery of an infant accommodation space; and a top hood that is attached to at least one of the first to fourth wall portions and forms an upper face of the infant accommodation space, wherein: the top hood is detachably attached to the at least one of the first to fourth wall portions of the peripheral frame by a first latch mechanism, the top hood is configured to be detachable from the peripheral frame by unlatching the first latch mechanism and releasing the top hood from a latched state effected by the first latch mechanism, the first wall portion, the second wall portion, the third wall portion, and the fourth wall portion are detachably attached to the incubator base by a second latch mechanism, a third latch mechanism, a fourth latch mechanism, and a fifth latch mechanism, respectively, and each of the first to fourth wall portions is configured to be detachable from the incubator base by unlatching a corresponding latch mechanism of the second latch mechanism, the third latch mechanism, the fourth latch mechanism, and the fifth latch mechanism, and releasing the respective wall portions from a latched state effected by the corresponding latch mechanism.

By configuring the incubator in this way, it is relatively easy to transport all the components of the incubator in a state in which each of the first to fourth wall portions configuring the peripheral frame and the top hood among the components of the incubator are not directly or indirectly (in other words, formally) attached to the incubator base, and transportation costs for transporting all the components of the incubator can be kept relatively low. Moreover, since the work of thoroughly cleaning the incubator base, each of the first to fourth wall portions, and the top hood is relatively easy, even if the body fluid or the like of an infant sticks between the top hood, the first to fourth wall portions, and the incubator base, another infant can be relatively easily prevented from becoming infected. Furthermore, when at least one of the incubator base, the first to fourth wall portions, or the top hood is partially or completely damaged, the work of repairing the damaged section or replacing the part having the damaged section is generally relatively easy.

In the aspect of the disclosure, the incubator may further include an incubator base support mechanism that is configured to support the incubator base.

By configuring the incubator in this way, since the incubator further includes the incubator base support mechanism that may support the incubator base, it is not particularly necessary to mount the incubator base (and therefore the incubator base having the peripheral frame and the top hood attached to it) on a table or desk. Therefore, it is relatively easy to place the incubator base, the peripheral frame, and the top hood in an appropriate location in a relatively stable state.

In the aspect of the disclosure, the incubator base support mechanism may include: a trolley body having an opening formed by at least one side surface being substantially entirely open; a left and right pair of doors that are swingably attached to the trolley body and open and close the opening of the trolley body; and wheels that are disposed at the trolley body and are for moving the incubator.

By configuring the incubator in this way, since the first to fourth wall portions and the top hood may be stored through the opening of the trolley body inside the trolley body, even in a state in which the first to fourth wall portions and the top hood are detached from the incubator base, the appearance of the incubator is good. Further, there is little concern that the first to fourth wall portions and the top hood will become damaged.

Furthermore, in the aspect of the disclosure, the incubator base support mechanism may include: a strut portion having an upper end portion connected to a lower end portion of the incubator base; a trolley body that is configured to support a lower end portion of the strut portion; a pair of foot portions that are respectively connected to an end portion at one side of the trolley body and to an end portion at another side that is at the opposite side from the one side; and wheels that are attached to both end portions of each of the pair of foot portions.

By configuring the incubator in this way, the first to fourth wall portions and the top hood may be stored in a space under the incubator base. Therefore, even when the first to fourth wall portions and the top hood are detached from the incubator base, and the incubator base and the incubator base support mechanism are stored in a packaging container, the appearance of the incubator is good and there is little concern that the first to fourth wall portions and the top hood will become damaged.

Additionally, in the aspect of the disclosure, the outer periphery of the infant accommodation space may be substantially rectangular in shape in plan view.

By configuring the incubator in this way, since the outer periphery of the infant accommodation space is substantially rectangular in shape when the infant accommodation space is viewed in plan, the incubator and the constituent members of the incubator may be stored and packed relatively easily and reliably in a packaging container such as a cardboard box that is substantially cuboid in shape, and therefore, handling during transport is easy and convenient.

Furthermore, in the aspect of the disclosure, the top hood may be detachably attached to at least two fixed wall portions among the first to fourth wall portions by the first latch mechanism.

By configuring the incubator in this way, the top hood is detachably attached by the first latch mechanism to the at least two fixed wall portions. Therefore, the top hood can be reliably attached to the peripheral frame in a relatively stable state.

Furthermore, in the aspect of the disclosure, a lower end portion of at least one movable wall portion other than the fixed wall portions among the first to fourth wall portions may be pivotally supported so as to be swingable about the incubator base, and the at least one movable wall portion may be configured to be capable of swinging back and forth between a substantially upright state and a substantially downward hanging state using its lower end portion as a pivot point.

By configuring the incubator in this way, the at least one movable wall portion is able to be swung back and forth between the substantially upright state and the substantially downward hanging state using its lower end portion as a pivot point. Therefore, a doctor or nurse may administer various types of care relatively easily to the infant in the infant accommodation space in the incubator.

Moreover, in the aspect of the disclosure, the incubator may be a closed type incubator.

By configuring the incubator in this way, since the incubator is a closed type incubator, an incubator that has a relatively simple structure and is relatively difficult to experience a failure may be provided.

The features of the present disclosure will be apparent from the detailed description set forth below when taken in conjunction with the accompanying drawings.

DETAILED DESCRIPTION OF THE PREFERRED EMBODIMENTS

Next, first and second embodiments in which the disclosure is applied to closed type incubators will be described below with reference to the drawings.

1. First Embodiment

First, the first embodiment of the disclosure will be described with reference to FIG. 1 to FIG. 13.

(1) General Description of Incubator Overall

Figure 1:
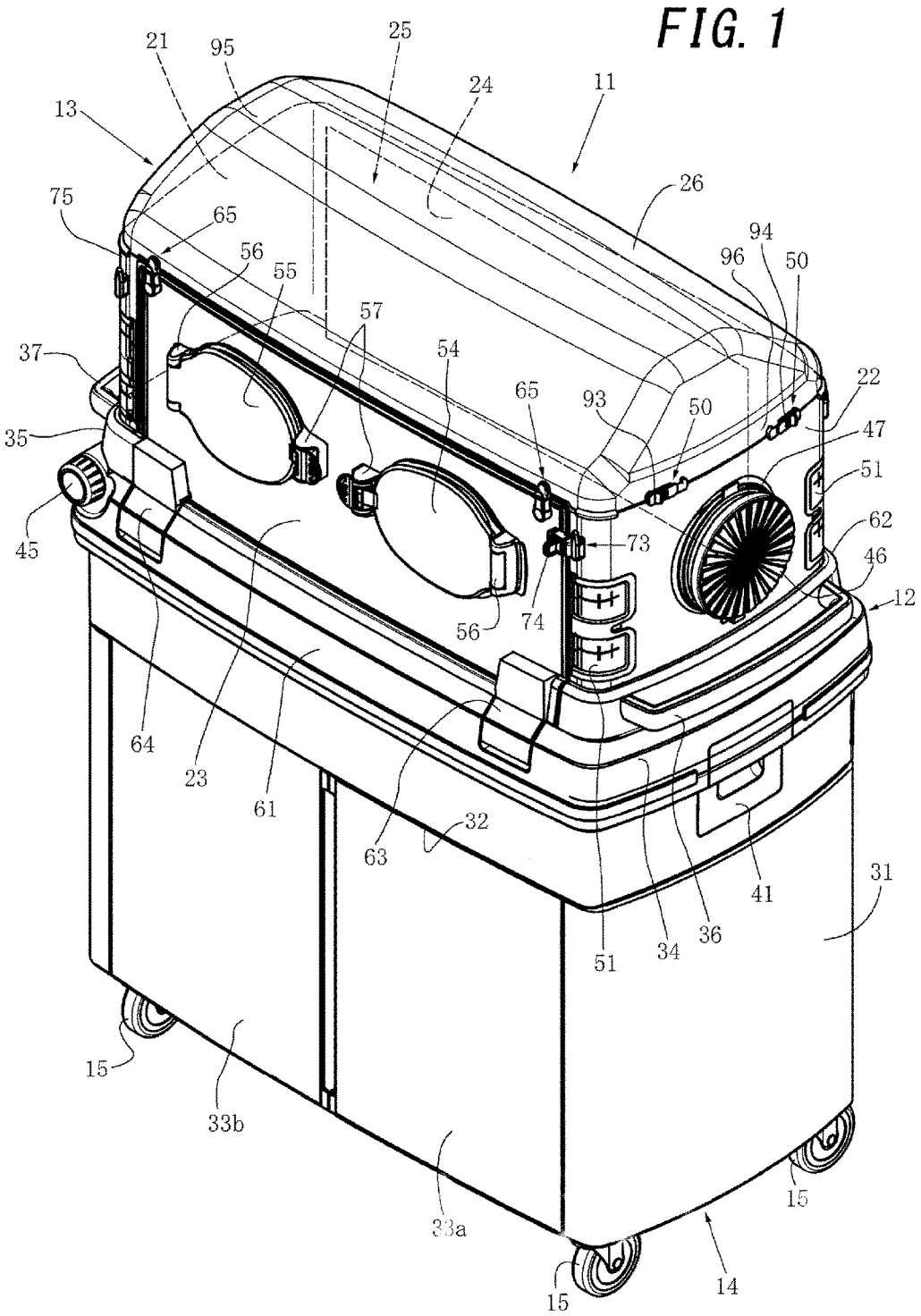
FIG. 1 is a perspective view of an incubator of a first embodiment in which the disclosure is applied to a closed type incubator.

As illustrated in FIG. 1 and the other drawings, a closed type incubator 11 includes an incubator base 12 that has a substantially rectangular shape (in other words, substantially cuboid shape in overall) when viewed in plan, an enclosure 13 that has a substantially cuboid shape and is standing on top of the incubator base 12 along the substantial outer periphery of the incubator base 12, and a trolley 14 that serves as an incubator base support section or an incubator base support mechanism and has the incubator base 12 attached and secured to its substantial upper surface. The enclosure 13 is attached and secured to the incubator base 12 such that it is easily able to be attached to and detached from the enclosure 13. Furthermore, wheels 15 used for moving the incubator 11 are attached to the substantial four corners of the bottom surface of the trolley 14, and the trolley 14 is supported on the wheels 15. The incubator base 12 may be secured and attached to the trolley 14 such that it is easily able to be attached to and detached from the incubator base 12 as needed, or the incubator base 12 may be attached and secured to the trolley 14 such that the incubator base 12 cannot be easily detached once the incubator base 12 has been attached to the trolley 14. For example, the incubator base 12 may be detachably attached and secured to the trolley 14 by connectors (not illustrated in the drawings) including bolts and nuts.

As illustrated in FIG. 1 and other drawings, the enclosure 13 includes:

(a) a head-side wall portion 21 configuring a wall portion at the head side of an infant accommodated in the enclosure 13 (in other words, one wall portion of a pair of wall portions extending in a width direction of the enclosure 13);

(b) a foot-side wall portion 22 configuring a wall portion at the foot side of the infant (in other words, the other wall portion of the pair of wall portions extending in the width direction of the enclosure 13, which is substantially opposing the first wall portion 21);

(c) a front wall portion 23 (a wall portion at the right side of the infant; a third wall portion that is one wall portion of a pair of wall portions extending in a length direction of the enclosure 13);

(d) a rear wall portion 24 (a wall portion at the left side of the infant; a fourth wall portion that is the other wall portion of the pair of wall portions extending in the length direction of the enclosure 13); and (e) a top hood 26 disposed so as to cover the substantial entire upper side of an infant accommodation space 25 surrounded by the wall portions 21 to 24.

The entirety of the enclosure 13 may be substantially transparent or substantially semitransparent. Each of the wall portions 21 to 24 and the top hood 26 may, for example, be configured from a substantially transparent or substantially semitransparent material, such as a substantially transparent thermoplastic resin (e.g. a substantially transparent acrylic resin) or other substantially transparent or substantially semitransparent synthetic resin.

The entirety of the trolley 14 illustrated in FIG. 1 and the other drawings may be made of metal such as stainless steel, and may be substantially box-like in shape such as substantially cuboid shape. The trolley 14 includes a trolley body 31, which has an opening 32 formed as a result of at least one side surface such as the front surface being substantially entirely open, and a left and right pair of doors 33*a* and 33*b*, which are swingably attached to the trolley body 31 in order to open and close the opening 32 of the trolley body 31. The left door 33*a* is attached to the trolley body 31 such that the left door 33*a* is able to be swung back and forth using the vicinity of the left end portion of the trolley body 31 as a pivot point. Furthermore, the right door 33*b* is attached to the trolley body 31 such that the right door 33*b* is able to be swung back and forth using the vicinity of the right end portion of the trolley body 31 as a pivot point.

As illustrated in FIG. 1 and the other drawings, a left handle 36 and a right handle 37 are attached and secured to outer surfaces in the vicinities of upper portions of a left wall portion 34 and a right wall portion 35, respectively, of the base 12. The left and right handles 36 and 37 may have substantially flat U-shape. Both end portions of each of the handles 36 and 37 may be attached and secured to, or integrally molded with, the left wall portion 34 and the right wall portion 35, respectively. Moreover, a humidifier unit 41 is removably loaded in the left side portion of the base 12 such that the humidifier unit 41 may be removed from the base 12 by pulling it out. An angle adjustment knob 45 used when adjusting the angle of inclination from a head-side section 43 to a foot-side section 44 of a bed base 42 (see FIG. 8) disposed inside the enclosure 13 is disposed at the right side portion of the base 12.

Figure 8:
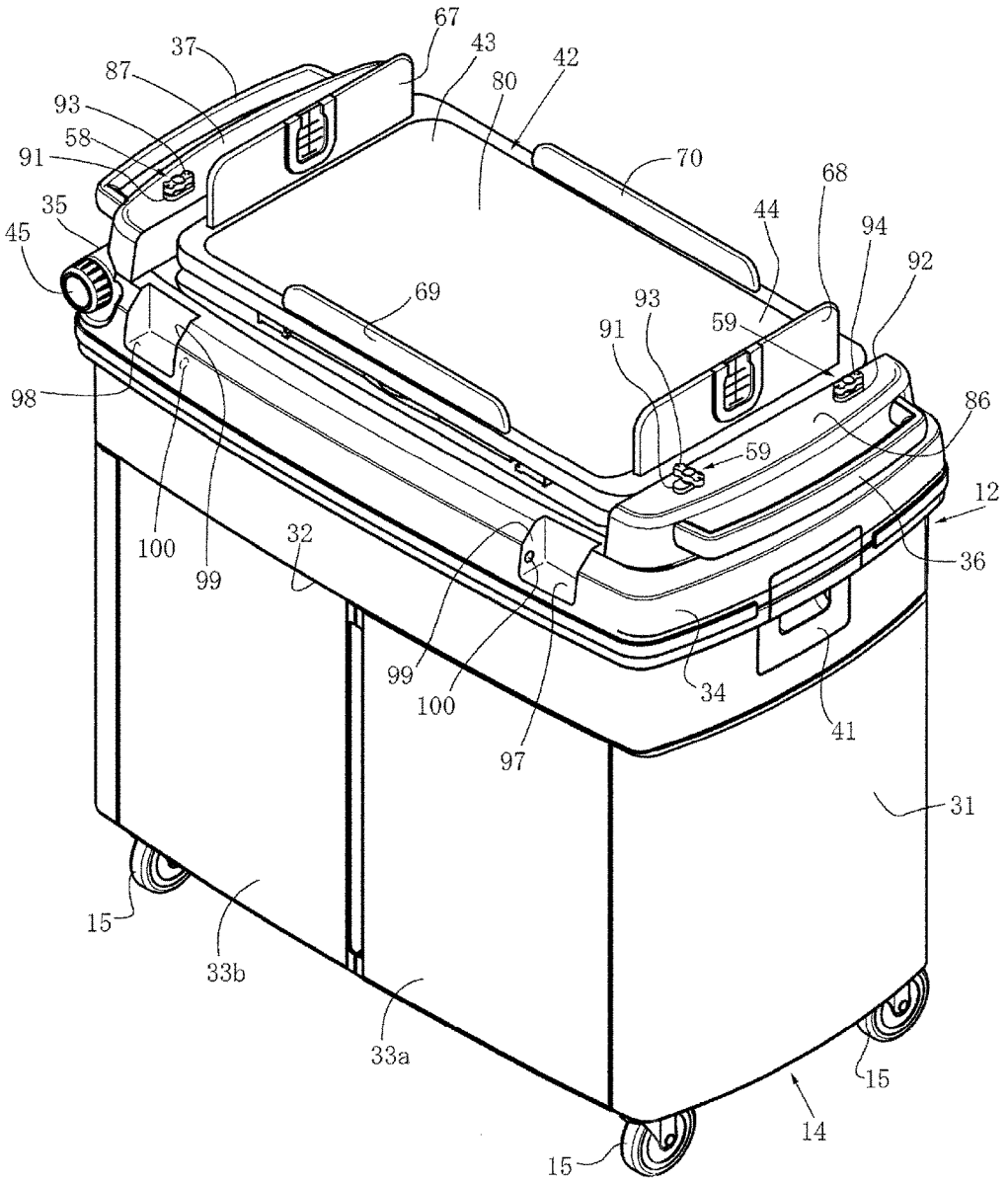
FIG. 8 is a perspective view illustrating the incubator of FIG. 1, in a state in which the top hood, a head-side wall portion, the foot-side wall portion, the front wall portion, and a rear wall portion are detached.
Figure 9:
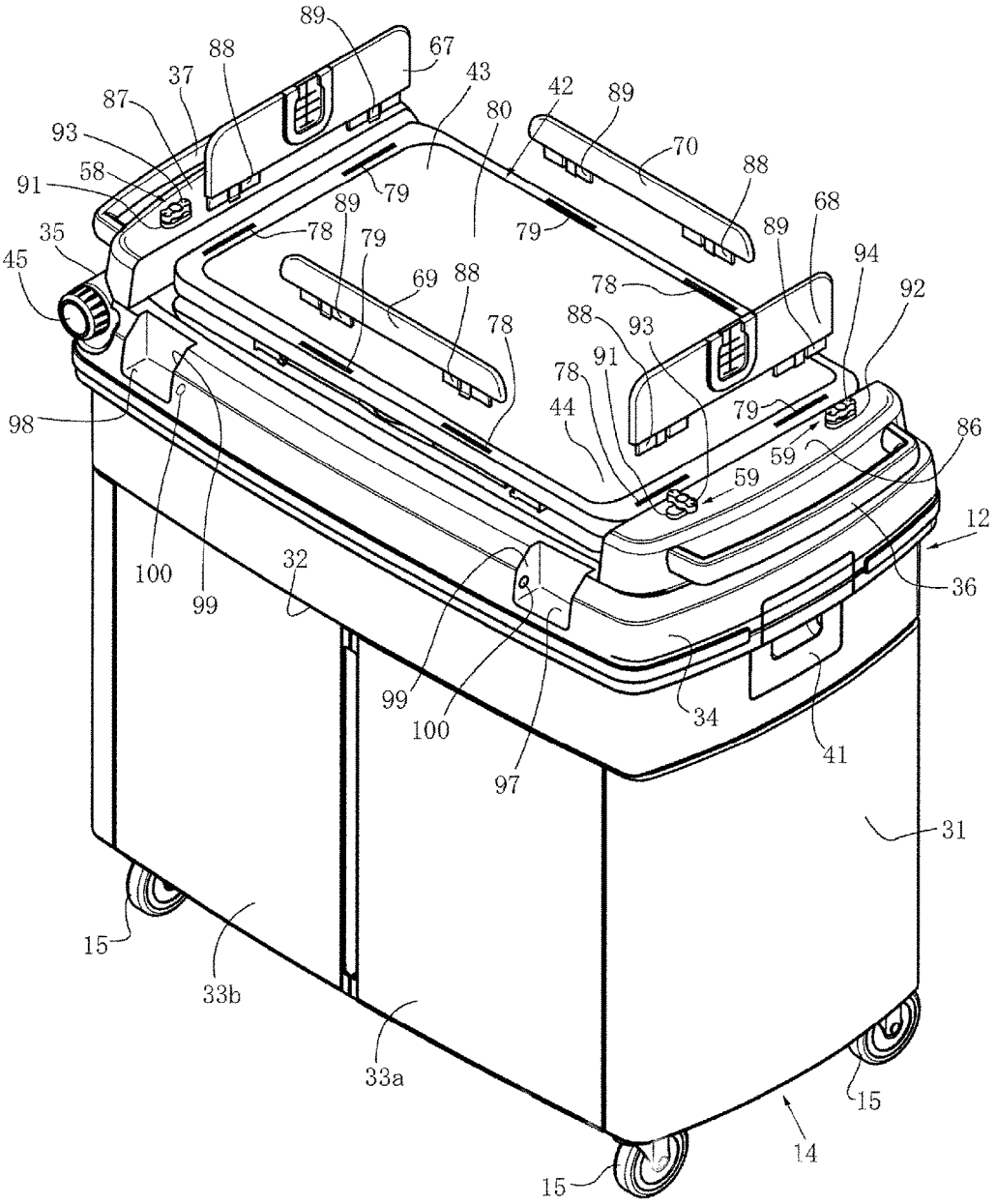
FIG. 9 is a perspective view illustrating the incubator of FIG. 8, in a state in which baby guard wall portions are separated from the incubator base.

As illustrated in FIG. 8 and FIG. 9, a head-side auxiliary wall portion 67, a foot-side auxiliary wall portion 68, a front auxiliary wall portion 69, and a rear auxiliary wall portion 70 are disposed at the head-side, foot-side, front, and rear end portions, respectively, of the bed base (in other words, mattress tray) 42. Specifically, pairs of insertion slits 78 and 79 are disposed one pair in each of the head-side, foot-side, front, and rear end portions of the bed base 42 along the length directions thereof. Pairs of insertion portions 88 and 89 are disposed one pair on each of the auxiliary wall portions 67 to 70, and by inserting the insertion portions 88 and 89 into the insertion slits 78 and 79, respectively, the auxiliary wall portions 67 to 70 are attached and secured to the mattress tray 42 such that the auxiliary wall portions 67 to 70 are able to be detached relatively easily. The auxiliary wall portions 67 to 70 may substantially prevent an infant such as a newborn infant lying on a mattress 80 disposed on the bed base 42 from sticking out from the mattress 80.

(2) Head-Side, Foot-Side, Front, and Rear Wall Portions

Figure 2:
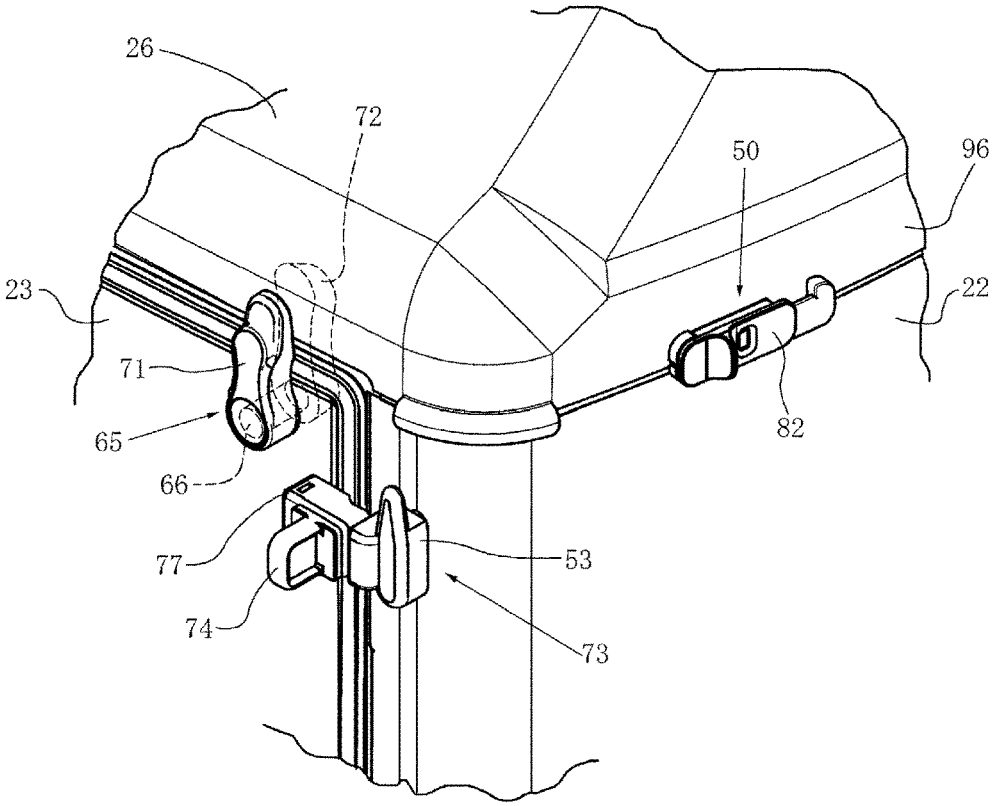
FIG. 2 is a perspective view illustrating a connection mechanism for connecting a top hood to a foot-side wall portion, and a lock mechanism for a front wall portion in the incubator illustrated in FIG. 1.
Figure 3:
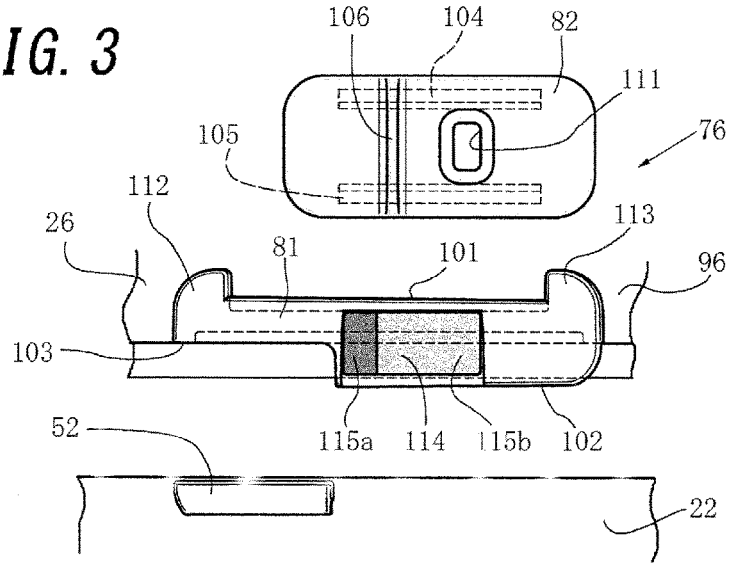
FIG. 3 is a plan view illustrating the connection mechanism for the top hood and the foot-side wall portion illustrated in FIG. 2, in a first separated state in which the top hood is separated from the foot-side wall portion.
Figure 11:
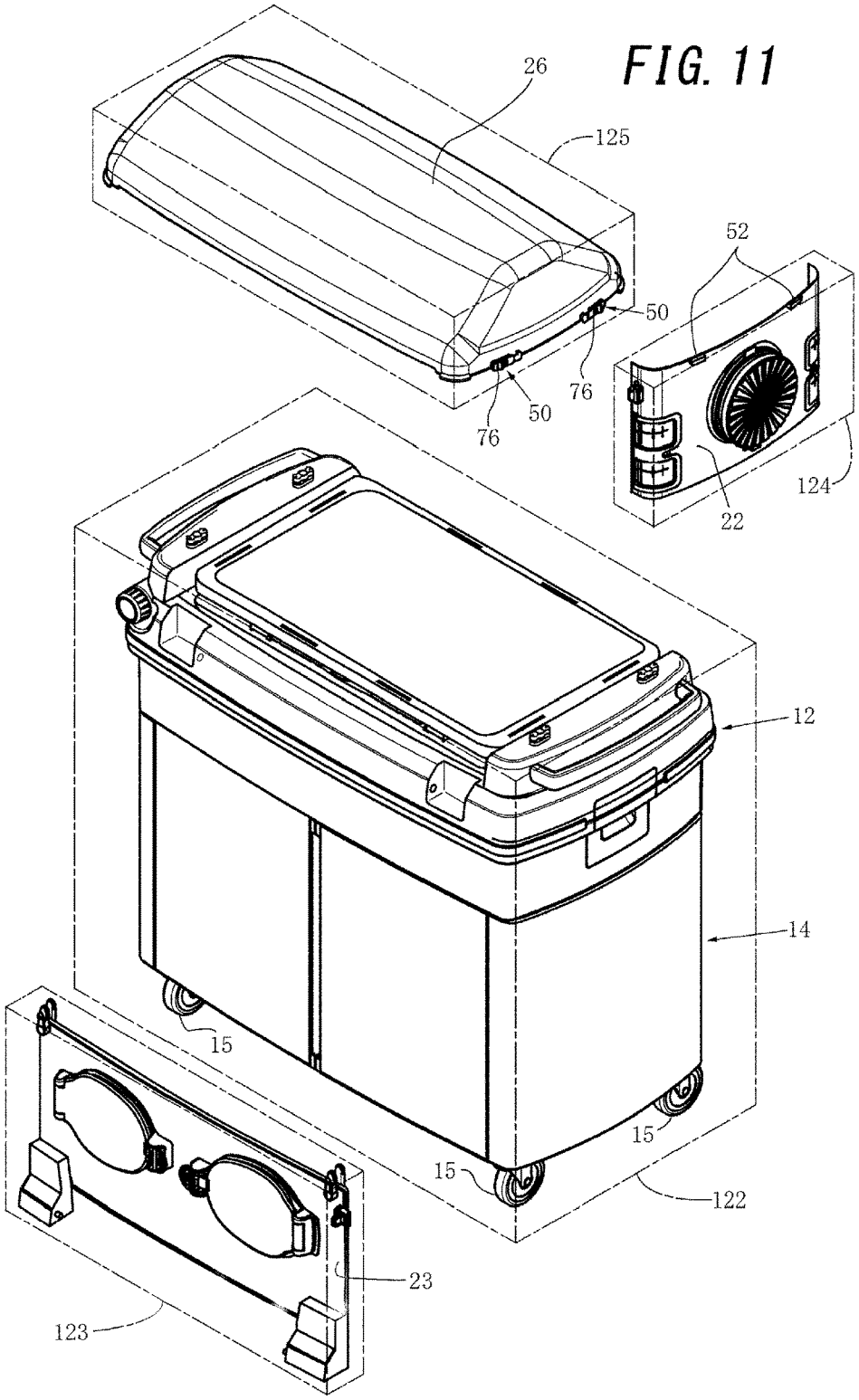
FIG. 11 is a perspective view schematically illustrating the incubator of FIG. 1, in a packed state in which the top hood, the head-side wall portion, the foot-side wall portion, the front wall portion, and the rear wall portion are detached from an incubator body, and the incubator body, the top hood, the foot-side wall portion, and the front wall portion are individually packed.

The head-side wall portion 21 may be substantially identical in size and shape to the foot-side wall portion 22 illustrated in FIG. 1, FIG. 11, and the other drawings. As illustrated in FIG. 1 and the other drawings, a hand insertion opening 47, to which an iris port 46 made of cloth or the like is attached, is formed in the central section of each of the head-side wall portion 21 and the foot-side wall portion 22. Furthermore, cutouts are formed in the front section and the rear section of each of the head-side wall portion 21 and the foot-side wall portion 22. Grommet members 51 are attached to these cutouts. As illustrated in FIG. 1, FIG. 2, FIG. 3, and the other drawings, engaged portions 52 of a front and rear pair of latch mechanisms 50 are disposed by integral molding, for example, in the vicinity of the upper end of each of the head-side wall portion 21 and the foot-side wall portion 22. As illustrated in FIG. 2, FIG. 11, and the other drawings, a latch receiving portion 53 serving as an engaged portion is disposed by integral molding, for example, in the vicinity of the upper end portion of each of the rear end portion of the head-side wall portion 21 and the front end portion of the foot-side wall portion 22. An opening (not illustrated in the drawings) for attaching an accessory such as an oxygen sensor is formed in the vicinity of the rear end portion and the vicinity of the upper end portion of the head-side wall portion 21.

The front wall portion 23 illustrated in FIG. 1, FIG. 11, and the other drawings may be substantially identical in size and shape to the rear wall portion 24. A left access port 54 and a right access port 55 are disposed in the left section and the right section, respectively, of each of the front wall portion 23 and the rear wall portion 24. It should be noted that reference signs 56 denote pivot shaft portions of the left and right access ports 54 and 55. Reference signs 57 denote latch mechanisms of the left and right access ports 54 and 55.

As illustrated in FIG. 1 and the other drawings, a left hinge portion 63 and a right hinge portion 64 are disposed, so as to be swingable back and forth about pivot shaft portions (not illustrated in the drawings), in the vicinities of both the left and right sections of the vicinity of the upper end portion of each of a front section 61 and a rear section 62 of the base 12. A left and right pair of first latch mechanisms 65 that engage with the lower end portions on the front side and the rear side of the top hood 26 when the wall portions 23 and 24 are closed, are disposed at each of the front wall portion 23 and the rear wall portion 24. Each of the first latch mechanisms 65 includes a common shaft portion 66, which is pivotally supported so as to be turnable in either one of the front wall portion 23 or the rear wall portion 24, and an outside latch lever portion 71 and an inside latch lever portion 72, which are secured to the outer end portion and the inner end portion, respectively, of the common shaft portion 66. Moreover, as illustrated in FIG. 2 and the other drawings, a latch lever portion 74, serving as an engaging portion of the latch mechanism 73, and a lever support portion 77, for attaching the latch lever portion 74 to the wall portions 23 and 24 and supporting the latch lever portion 74, are disposed in the vicinity of the upper end portion and the vicinity of the left end portion of each of the front wall portion 23 and the rear wall portion 24 (in other words, in the vicinity of the right end portion of each of the wall portions 23 and 24 when seen from outside). When opening the front wall portion 23 or the rear wall portion 24, it suffices for an operator to move in one (forward) direction the latch lever portion 74 relative to the lever support portion 77 to disengage the latch lever portion 74 from the engaged portion 53, and thereafter open the front or rear wall portion 23 or 24.

(3) Top Hood

Figure 10:
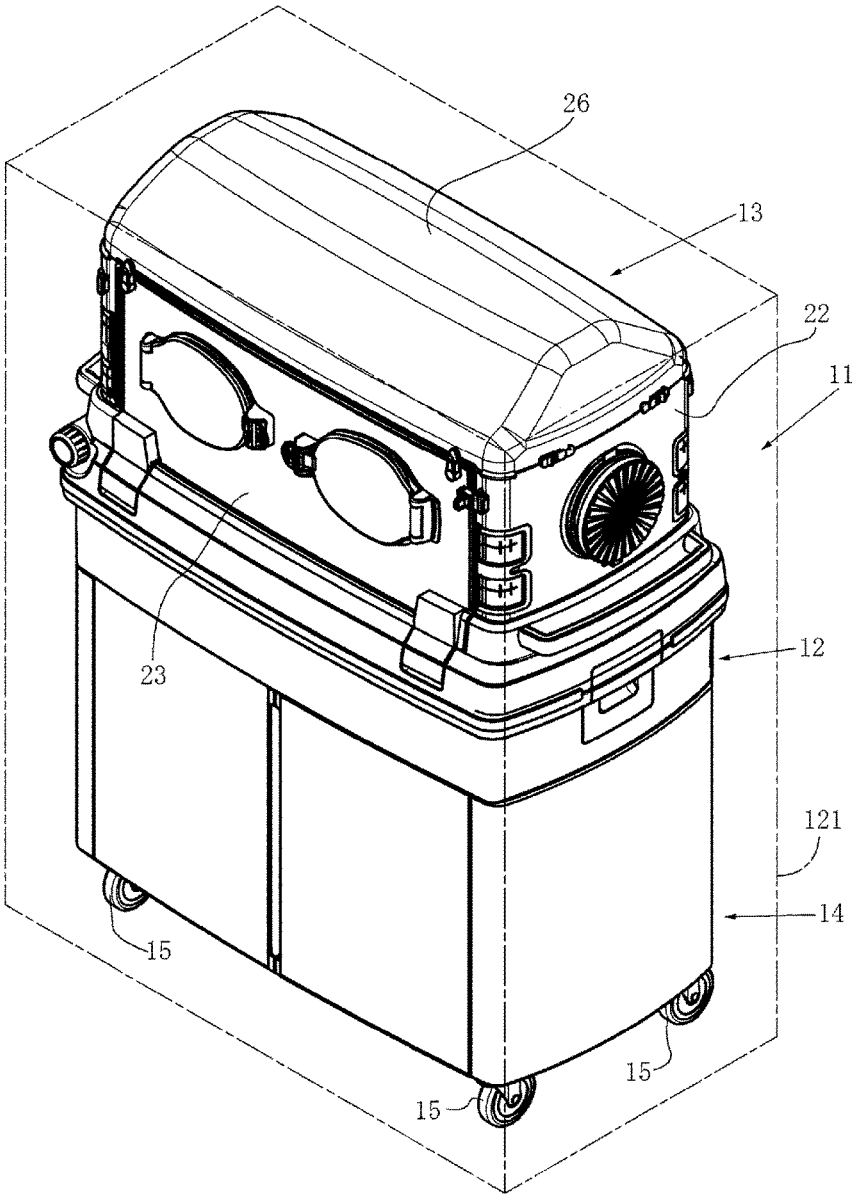
FIG. 10 is a perspective view schematically illustrating the incubator of FIG. 1 in a packed state in which the incubator is packed in a state substantially corresponding to the use state of the incubator.

As illustrated in FIG. 1, FIG. 10, and the other drawings, the top hood 26 may have a substantially quadrilateral frustum shape and may be a hollow body whose lower side is entirely open. A peripheral frame 75 that is substantially rectangular in shape when viewed in plan (in other words, a substantially rectangular tube shape whose upper side and lower side are entirely open) is configured by the head-side wall portion 21, the foot-side wall portion 22, the front wall portion 23, and the rear wall portion 24. The enclosure 13 is configured by the peripheral frame 75 and the top hood 26 that may selectively cover the opening at the upper side of the peripheral frame 75.

As illustrated in FIG. 1, FIG. 3, FIG. 11, and the other drawings, engaging portions 76 of a front and rear pair of latch mechanisms 50 are disposed in the front section and the rear section of each of the head-side end portion and the foot-side end portion of the top hood 26. Each engaging portion 76 includes a latch member support portion 81, which is disposed by integral molding, for example, at the lower end portion of the top hood 26, and a latch member 82, which is attached in a slidable manner in the substantially front-rear direction with respect to the support portion 81.

Figure 7:
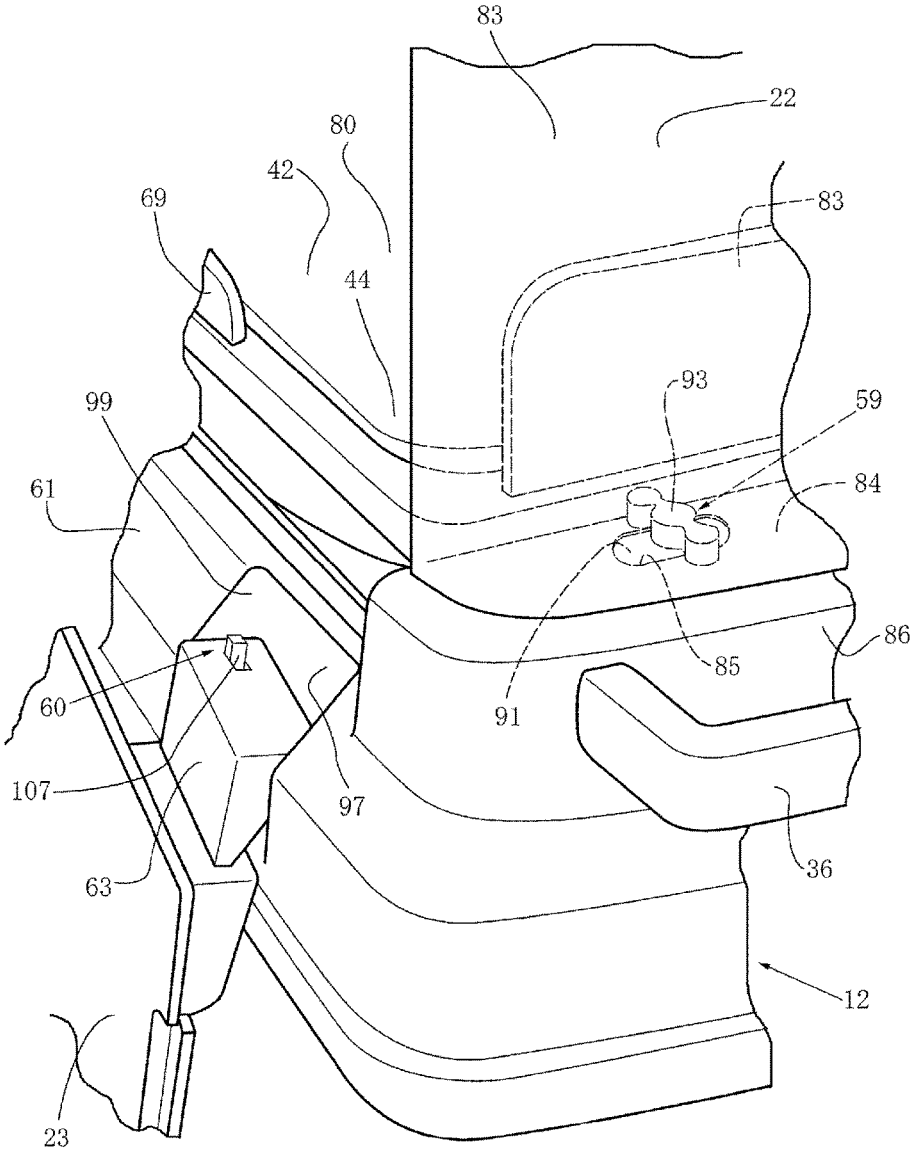
FIG. 7 is a perspective view illustrating a connection mechanism for connecting the foot-side wall portion to an incubator base, and a connection mechanism for connecting the front wall portion to the incubator base in the incubator illustrated in FIG. 1.

(4) Connection Mechanisms for Connecting Head-Side and Foot-Side Wall Portions to Incubator Base Each of the head-side wall portion 21 and the foot-side wall portion 22 illustrated in FIG. 1 and the other drawings includes a wall portion body 83, which is substantially upright, and an attached portion 84, which is disposed at the lower end portion of the wall portion body 83 while integrally projecting inward therefrom, and extends across the substantially entire length of the lower end portion of the wall portion body 83 (see also FIG. 7). A front and rear pair of engagement openings 85 that are long and narrow along the substantially front-rear direction and may have a substantially rectangular shape with semicircular ends (or an oval shape) are formed in each of the attached portions 84. Furthermore, in the vicinity of the front end portion and the rear end portion of each of a left side end portion 86 and a right side end portion 87 of the incubator base 2, a front projecting portion 91 and a rear projecting portion 92 for positioning that may be long and narrow along the substantially front-rear direction and may have a substantially rectangular shape with semicircular ends (or an oval shape) are integrally formed or otherwise secured to the left side end portion 86 and the right side end portion 87 (see also FIG. 8). Moreover, a front anchoring lever 93 and a rear anchoring lever 94, which may have a substantially identical shape to the projecting portions 91 and 92, are turnably attached to the upper surfaces of the front projecting portion 91 and the rear projecting portion 92, respectively.

When attaching and securing the foot-side wall portion 22 illustrated in FIG. 1, FIG. 7, and the other drawings to the incubator base 12, an operator substantially aligns the length directions of the front and rear anchoring levers 93 and 94 with the front-rear direction of the incubator base 12. Next, the operator mounts the attached portion 84 of the foot-side wall portion 22 on the left side end portion 86 of the incubator base 12. During this mounting, the operator relatively fits or inserts the front and rear projecting portions 91 and 92 and the front and rear anchoring levers 93 and 94 into the front and rear engagement openings 85. Next, the operator manually or otherwise turns the front and rear anchoring levers 93 and 94 substantially 90 degrees, for example. As a result, the front and rear projecting portions 91 and 92 are effectively prevented from relatively coming out of the front and rear engagement openings 85 by the front and rear anchoring levers 93 and 94. Thereby, the head-side wall portion 21 and the foot-side wall portion 22 are stably and strongly attached and secured to the substantially upper surface of the incubator base 12 by the front and rear anchoring levers 93 and 94. Consequently, the operations of attaching the head-side wall portion 21 and/or the foot-side wall portion 22 to the incubator base 12 and detaching the head-side wall portion 21 and/or the foot-side wall portion 22 from the incubator base 12 may be performed relatively easily and reliably. As seen above, second latch mechanisms 58 for the head-side wall portion 21 are configured by the front and rear anchoring levers 93 and 94 for the head-side wall portion (that is, the first wall portion) 21. Further, third latch mechanisms 59 for the foot-side wall portion 22 are configured by the front and rear anchoring levers 93 and 94 for the foot-side wall portion (i.e., the second wall portion) 22.

(5) Connection Mechanisms for Front and Rear Wall Portions and Incubator Base

The front wall portion 23 and the rear wall portion 24 illustrated in FIG. 1 and the other drawings are each supported on the incubator base 12 by a pivot shaft portion (not illustrated in the drawings) so as to be forwardly swingable. Specifically, as illustrated in FIG. 8 and the other drawings, a left recessed portion 97 and a right recessed portion 98 are formed in the vicinities of both the left and right end portions of the vicinity of the upper end portion of each of the front section 61 and the rear section 62 of the incubator base 12. A fitting hole 100 is disposed in a wall portion 99 at the center side in the left-right direction of each of the recessed portions 97 and 98. Furthermore, as illustrated in FIG. 1, FIG. 7, and the other drawings, the pivot shaft portions, which project toward the center side in the left-right direction of each of the front wall portion 23 and the rear wall portion 24, are disposed in the front wall portion 23 and the rear wall portion 24.

An operable portion 107 such as a slide-operable portion illustrated in FIG. 7 is disposed in each of the hinge portions 63 and 64 of the front wall portion 23 and the rear wall portion 24 by attachment and securement, a simple link structure, or integral molding, for example, such that the operable portions 107 may engage with the pivot shaft portions in an interlocking state. When the operator manually operates the operable portions 107, the operable portions 107 may be slid (in other words, operably moved in forward direction) toward the substantially opposite side of the center side in the left-right direction of each of the front wall portion 23 and the rear wall portion 24. Consequently, as illustrated in FIG. 8, the left and right pairs of pivot shaft portions may be pulled out from the fitting holes 100 in the incubator base 12, thereby enabling the front wall portion 23 and the rear wall portion 24 to be detached from the incubator base 12 extremely easily. When reattaching the front wall portion 23 and the rear wall portion 24 to the incubator base 12, it suffices for the operator to perform an attachment operation that is substantially the reverse operation of the detachment operation described above. As seen above, fourth latch mechanisms 60 for the front wall portion 23 are configured by the pair of operable portions 107 for the front wall portion (that is, the third wall portion) 23. Further, fifth latch mechanisms for the rear wall portion 24 are configured by the pair of operable portions 107 for the rear wall portion (that is, the fourth wall portion) 24. The fifth latch mechanism, although not illustrated in the drawings, may have a similar configuration to that of the fourth latch mechanisms 60 illustrated in FIG. 7.

(6) Connection Mechanisms for Top Hood and Peripheral Frame

As illustrated in FIG. 1 and the other drawings, the peripheral frame 75, whose upper end and lower end are both substantially entirely open, is configured by the front wall portion 23, the head-side wall portion 21, the rear wall portion 24, and the foot-side wall portion 22. The substantial entirety of the opening in the upper end of the peripheral frame 75 is covered by the top hood 26.

Figure 4:
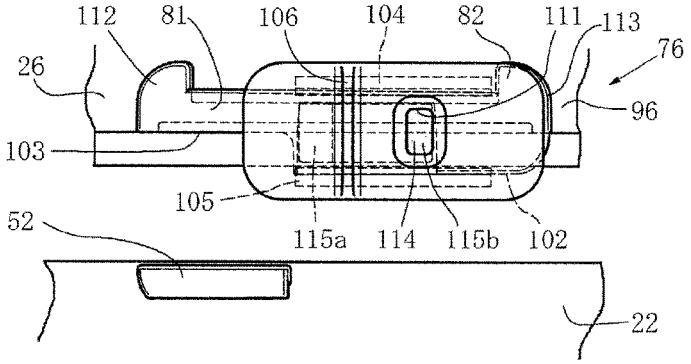
FIG. 4 is a plan view illustrating the connection mechanism for the top hood and the foot-side wall portion illustrated in FIG. 2, in a second separated state in which the top hood is separated from the foot-side wall portion.

As illustrated in FIG. 2, FIG. 4, and the other drawings, the lower end portion at the right side and the left side of the top hood 26 are attached and secured to the head-side wall portion 21 and the foot-side wall portion 22, respectively, by the front and rear pairs of latch mechanisms 50. By the engaged portions 52 provided at each of the head-side wall portion 21 and the foot-side wall portion 22 engaging with the latch member support portions 81 provided at the top hood 26, a head-side wall portion 95 of the top hood 26 and a foot-side wall portion 96 of the top hood 26 are connected to the head-side wall portion 21 and the foot-side wall portion 22, respectively, of the peripheral frame 75. Specifically, as illustrated in FIG. 4 and the other drawings, the latch member support portions 81 of the engaging portions 76 are connected to the top hood 26 by integral molding or the like. Each of the support portions 81 includes an upper guide portion 101 and a lower guide portion 102 for guiding the latch member 82. Furthermore, in the lower end portion of each of the support portions 81, a missing portion 103 is formed substantially in correspondence to the engaged portion 52 at the upper side of each of the head-side and foot-side wall portions 21 and 22.

As illustrated in FIG. 3 and the other drawings, an upper guided portion 104 and a lower guided portion 105 that are respectively guided by the upper guide portion 101 and the lower guide portion 102 of the support portion 81 are formed in each of the latch members 82. An operable protruding portion 106 extending in the substantially vertical direction from the substantially upper end to the substantially lower end of each of the latch members 82 is projected from the outer surface of each of the latch members 82. Furthermore, a window hole 111 that may be a through hole is formed in the latch member 82 between the upper guided portion 104 and the lower guided portion 105. Moreover, a front and rear pair of stopper portions 112 and 113 are projected from both the front-rear direction end portions of the upper guide portion 101 of each of the latch member support portions 81. An indicator label 114 that may be a color label is disposed in the front-rear direction middle section of each of the support portions 81. Each of the indicator labels 114 may include a first color section (e.g., green color) 115*a* and a second color section (e.g., red color) 115*b* that sequentially extend in the substantial length direction of each of the support portions 81.

Figure 5:
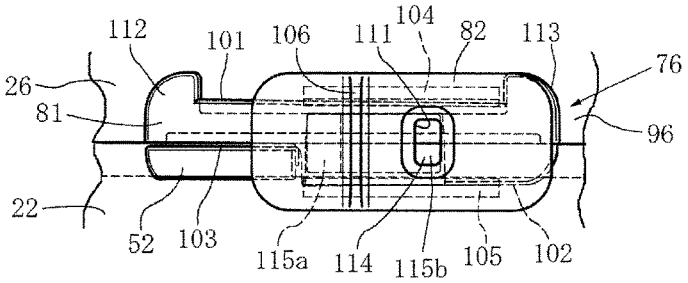
FIG. 5 is a plan view illustrating the connection mechanism for the top hood and the foot-side wall portion illustrated in FIG. 2, in a state in which the top hood is mounted on the foot-side wall portion and the connection mechanism is not functioning.

As illustrated in FIG. 1 and the other drawings, the lower end portions of each of the head-side wall portion 95 and the foot-side wall portion 96 of the top hood 26 may be detachably attached and secured to the upper end portions of the head-side and foot-side wall portions 21 and 22 of the peripheral frame 75 by the front and rear pairs of latch mechanisms 50 at the head side and the foot side. Specifically, as illustrated in FIG. 4, FIG. 5, and the other drawings, the operator may cause each of the engaging portions 76 of each of the head-side wall portion 95 and the foot-side wall portion 96 of the top hood 26 to engage with the engaged portions 52 disposed at the upper end portions of each of the head-side and foot-side wall portions 21 and 22. Next, for example, the operator may slide each of the latch members 82 along the upper and lower guide portions 101 and 102 of the latch member support portions 81 and from right to left in FIG. 3, by operating the operable protruding portions 106 by pinching it with two fingers. As a result, the upper and lower guided portions 104 and 105 of the latch members 82 are guided by the upper guide portion 101 and the lower guide portion 102 of each of the latch member support portions 81. Thereby, the latch members 82 move forward from the return position illustrated in FIG. 5 to the forward position illustrated in FIG. 6. Consequently, the latch member support portions 81 (and therefore the vicinity of the lower end portion of the head-side wall portion 95 or the foot-side wall portion 96 of the top hood 26) are attached and supported in the vicinity of the upper end portion of the head-side wall portion 21 or the foot-side wall portion 22.

Figure 6:
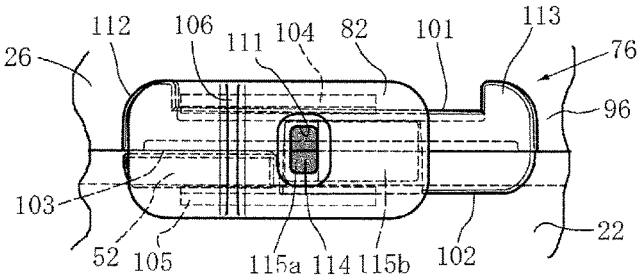
FIG. 6 is a plan view illustrating the connection mechanism for the top hood and the foot-side wall portion illustrated in FIG. 2, in a state in which the top hood is mounted on the foot-side wall portion and the connection mechanism is functioning.

As illustrated in FIG. 5, when the latch member 82 is in the return position relative to the latch member support portion 81, the second color section (e.g., red color) is indicated in the window hole 111. As illustrated in FIG. 6, when the latch member 82 is in the forward position relative to the latch member support portion 81, the first color section (e.g., green color) is indicated in the window hole 111. Consequently, by identifying the colors indicated in the window hole 111, the operator may easily and reliably see whether or not each of the latch mechanisms 50 is reliably attaching and supporting predetermined locations of the top hood 26 in predetermined locations of the head-side wall portion 21 or the foot-side wall portion 22.

In order for the front wall portion 23 and the rear wall portion 24 to be reliably held in the return position illustrated in FIG. 2 and the other drawings, the latch mechanisms 65 illustrated in FIG. 2 and the other drawings are disposed at each of the front wall portion 23 and the rear wall portion 24. After putting the latch mechanisms 65 in a state other than the substantially upright state illustrated in FIG. 2 (e.g., a state in which the latch mechanisms 65 are substantially hanging downward or a state in which the latch mechanisms 65 are substantially turned on their sides), the front wall portion 23 or the rear wall portion 24 may be swung from an open position to a closed position, and thereafter, the latch mechanisms 65 may be placed in the substantially upright state by turning the latch mechanisms 65 using the shaft portions 66 as pivot points. By turning the latch mechanisms 65 in this way the front wall portion 23 or the rear wall portion 24 may be reliably and easily locked to the closed position. Furthermore, the front wall portion 23 or the rear wall portion 24 may be unlocked by performing a reverse operation of the above described operation. When opening the front wall portion 23 or the rear wall portion 24, it suffices for the operator to unlock the front wall portion 23 or the rear wall portion 24 and thereafter disengage the latch lever portion 74 from the engaged portion 53 as described in "(2) Head-side, Foot-side, Front, and Rear Wall Portions" section.

(7) How to Packing Incubator

When it is necessary to package the closed type incubator 11 illustrated in FIG. 1 and the other drawings for conveyance, for example, the incubator 11 may be stored in a packaging container made of paper such as cardboard, plastic, wood, or the like. FIG. 10 illustrates a state in which the entire closed type incubator 11 (i.e., the incubator 11 in a state in which the enclosure 13 is not detached from the incubator base 12) is simply stored and packed in a relatively large, single packaging container (for example, a cardboard box having at least one surface that can be opened and closed) 121 that may be substantially cuboid in shape. In this case, because the closed type incubator 11 is bulky, it is necessary to use the bulky packaging container 121 preferably having a size that is capable of storing the entire closed type incubator 11.

FIG. 11 illustrates a state in which the enclosure 13 of the closed type incubator 11 is detached from the incubator base 12. In this state, the peripheral frame 75 is detached from the incubator base 12. Furthermore, the top hood 26 is detached from the peripheral frame 75. Moreover, the peripheral frame 75 is separated into the head-side wall portion 21, the foot-side wall portion 22, the front wall portion 23, and the rear wall portion 24.

When detaching the enclosure 13 from the incubator base 12 illustrated in FIG. 1, the operator may detach the enclosure 13 in the following order. First, the operator detaches the front wall portion 23 and the rear wall portion 24 from the incubator base 12. In this case, the operator may open the front wall portion 23 and the rear wall portion 24 as illustrated in FIG. 7 by performing the operation described above and then operably moves the operable portions 107 at both the left and right sides in the forward direction as described above. Then, the operator pulls the left and right pairs of pivot shaft portions out from the fitting holes 100 in the incubator base 12. Thus, the front wall portion 23 and the rear wall portion 24 may be detached extremely easily from the incubator base 12 by the operator and the like.

Next, as illustrated in FIG. 1, FIG. 2, and the other drawings, the operator may detach the top hood 16 attached to the head-side wall portion 21 and the foot-side wall portion 22 from these wall portions 21 and 22. In this case, the operator may detach the top hood 26 from the wall portions 21 and 22 by performing substantially a reverse operation of the attaching operation of the top hood 26 to the wall portions 21 and 22 using the latch mechanisms 50, which has been already described above. Next, the operator detaches the head-side wall portion 21 and the foot-side wall portion 22 attached to the incubator base 12 from the same. In this case, it suffices for the operator to detach the head-side wall portion 21 and the foot-side wall portion 22 from the incubator base 12 by performing substantially a reverse operation of the attaching operation of the head-side wall portion 21 and the foot-side wall portion 22 to the incubator base 12 using the front anchoring levers 93 and the rear anchoring levers 94, which has been already described above. Next, the operator may detach the auxiliary wall portions 67 to 70 disposed at the head-side, foot-side, front, and rear end portions of the bed base 42. Specifically, the operator may pull each of the auxiliary wall portions 67 to 70 out from the insertion slits 78 and 79 in the bed base 42.

Next, as illustrated in FIG. 11, the trolley 14 having the incubator base 12 mounted thereon and attached thereto is stored and packed in a packaging container 122 that is relatively smaller than the packaging container 121. The front wall portion 23 and the rear wall portion 24 are each stored and packed in packaging containers 123 that may have a right size that can substantially store each of the wall portions 23 and 24 therein. Furthermore, the head-side wall portion 21 and the foot-side wall portion 22 are each stored and packed in packaging containers 124 that may have a right size that can substantially store each of the wall portions 21 and 22 therein. Moreover, the top hood 26 is also stored and packed in a packaging container 125 that may have a right size that can substantially store the top hood 26 therein. It should be noted that each of the packaging containers 122 to 125 may, for example, be a cardboard box that may substantially have a cuboid shape and may have at least one surface that can be opened and closed (i.e., that is freely openable). Each of the trolley 14 having the incubator base 12 attached to it, the front wall portion 23, the rear wall portion 24, the head-side wall portion 21, the foot-side wall portion 22, and the top hood 26 may be stored and packed in any one of the packaging containers 122 to 125 having suitable sizes in the state before they are directly or indirectly attached to the incubator base 12.

Figure 12:
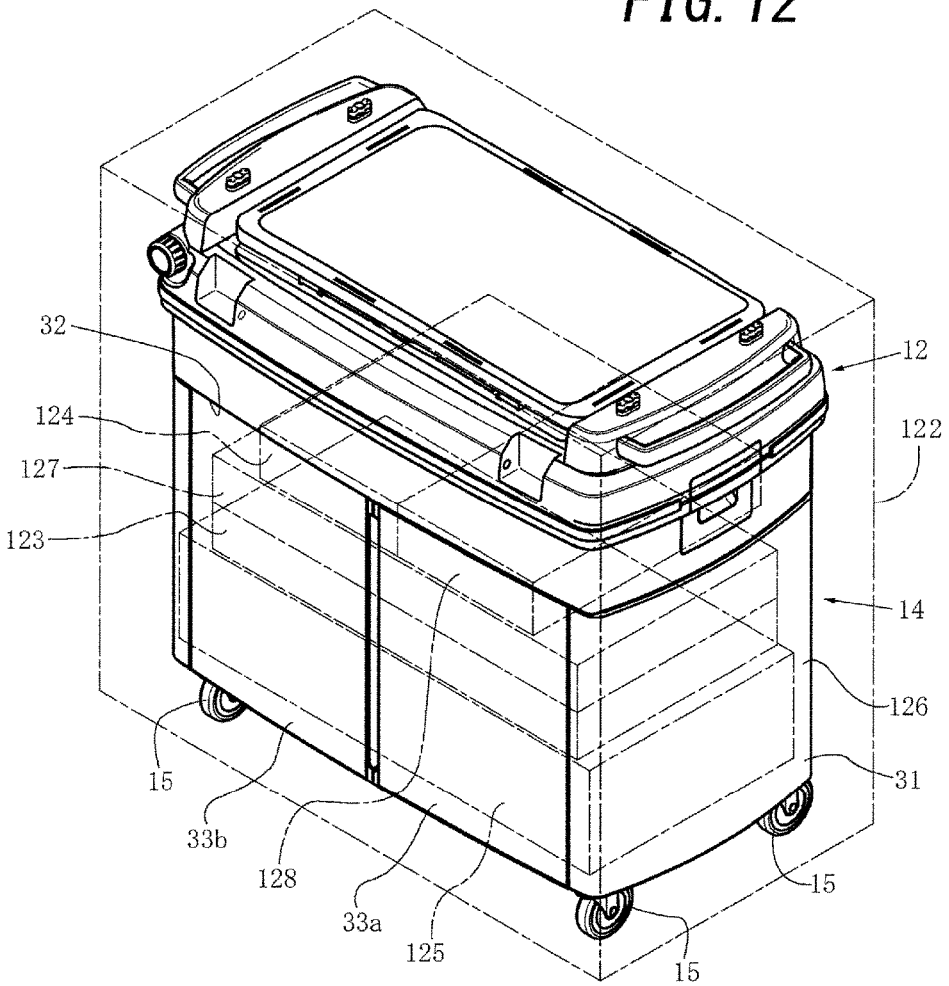
FIG. 12 is a perspective view schematically illustrating the incubator of FIG. 11 in an item-stored state in which the top hood, the head-side wall portion, the foot-side wall portion, the front wall portion, and the rear wall portion are stored in an item storage space in the incubator body.

FIG. 12 illustrates a state in which the packaging containers 123, 124, and 125 illustrated in FIG. 11 are stored inside the packaging container 122. In this example illustrated in FIG. 12, the trolley 14 having the incubator base 12 attached thereto includes an item storage space having the opening 32 in the front surface of the trolley 14. Furthermore, the item storage space is surrounded by a frame body 126 of the trolley 14, which is substantially U-shaped when viewed in plan, and the left and right pair of doors 31*a* and 31*b* that are capable of opening and closing the front surface of the item storage space. The frame body 126 includes an upper panel portion and a lower panel portion and, therefore, the frame body 126 is configured in a substantially cuboid shape by also including the left and right pair of doors 31*a* and 31*b*. In FIG. 12, the packaging container 125 storing the top hood 26 and the pair of packaging containers 123 and 127 respectively storing the front wall portion 22 and the front and rear wall portions 23 and 24 are stacked on the lower panel portion from the bottom toward above. Furthermore, the pair of packaging containers 124 and 128 respectively storing the head-side wall portion 21 and the foot-side wall portion 22 are stacked on the packaging container 127. In this case, one packaging container 128 may be substantially adjacent to the other packaging container 124 at the left side thereof. The auxiliary wall portions 67 to 70 may be stored, for example, in a section inside the top hood 26, for example, after having been individually stored, or grouped together and stored, in storage bags (not illustrated in the drawings) made of cloth or made of paper.

Figure 13:
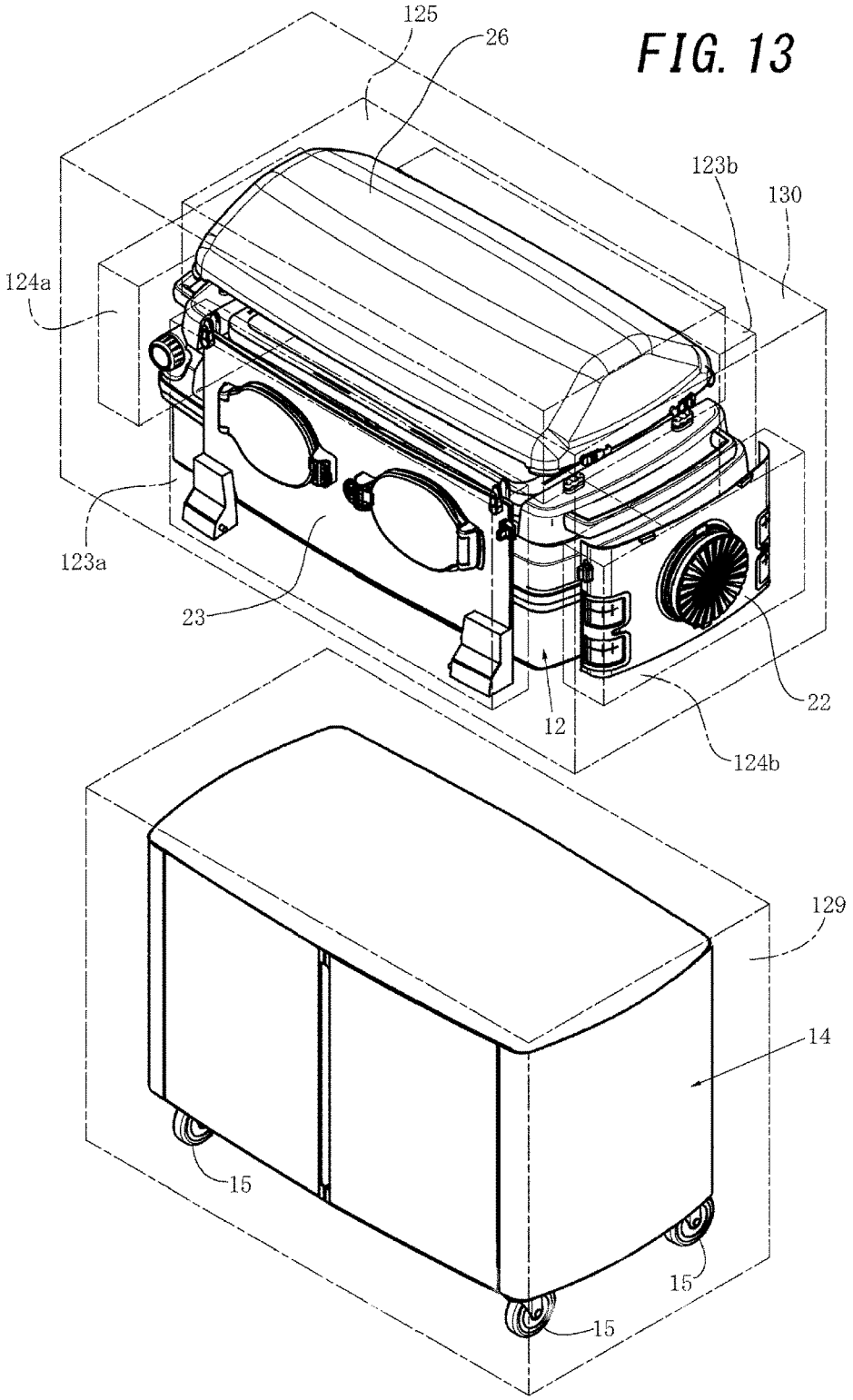
FIG. 13 is a perspective view schematically illustrating the incubator of FIG. 1, in a packed state in which the top hood, the head-side wall portion, the foot-side wall portion, the front wall portion, and the rear wall portion are detached from the incubator base and separated into a trolley and the incubator base, with the incubator base, the top hood, the head-side wall portion, the foot-side wall portion, the front wall portion, and the rear wall portion all being packed together and with the trolley being packed by itself.

FIG. 13 illustrates a state in which the incubator base 12 and the enclosure 13 of the closed type incubator 11 are detached from the trolley 14. In this state, the combined structure of the incubator base 12 and the enclosure 13 is detached from the trolley 14. When detaching the incubator base 12 and the enclosure 13 from the trolley 14, it suffices for the operator to release couplers that are the coupling of the incubator base 12 to the trolley 14 (not illustrated in the drawings) and then separate the combined structure from the trolley 14 as illustrated in FIG. 13.

Next, as illustrated in FIG. 13, the trolley 14 may be stored and packed in a packaging container 129 that is a relatively smaller than the packaging container 122 illustrated in FIG. 11. The incubator base 12 may be stored and packed in a packaging container 130 that may have a substantially identical size or a different size from the packaging container 129. Moreover, the top hood 26, the head-side wall portion 21, the foot-side wall portion 22, the front wall portion 23, and the rear wall portion 24 may be stored and packed in packaging containers 125, 124*a*, 124*b*, 123*a*, and 123*b*, respectively, that may have a substantially identical size or a different size from those illustrated in FIG. 11. Each of the packaging containers 129, 130, 125, 124*a*, 124*b*, 123*a*, and 123*b* may, for example, be a cardboard box that may have a substantially cuboid shape and may have at least one surface that can be opened and closed (i.e., that is freely openable). The packaging containers 125, 124*a*, 124*b*, 123*a*, and 123*b* respectively storing the top hood 26, the head-side wall portion 21, the foot-side wall portion 22, the front wall portion 23, and the rear wall portion 24 therein may be stored and packed in the packaging container 130 in a state in which the top hood 26 and the wall portions 21 to 24 are placed in the vicinities of the positions in which these components are normally to be attached to the incubator base 12.

When more than one closed type incubator 11 illustrated in FIG. 1 are each packed as illustrated in FIG. 10 and then simultaneously transported by transporting means such as a cargo ship, a freight train, or a truck, each of the closed type incubators 11 is relatively bulky. Therefore, the per-unit cost of transporting the closed type incubators 11 becomes relatively high. However, when more than one closed type incubator 11 illustrated in FIG. 1 are each packed as illustrated in FIG. 11 or FIG. 12 and then simultaneously transported by the transporting means, each closed type incubator 11 (i.e., all whole components of the incubator 11) is not bulky as in FIG. 10 and is relatively compact. Therefore, the per-unit cost of transporting the closed type incubators 11 particularly abroad may be kept relatively low. Further, the operation of assembling and restoring the closed type incubator 11 packed as illustrated in FIG. 11 or FIG. 12 to the state illustrated in FIG. 1 is relatively simple. Furthermore, it is relatively easy to separate the closed type incubator 11 as illustrated in FIG. 11 into the incubator base 12 having the trolley 14 attached to it, the wall portions 21 to 24, and the top hood 26. Therefore, the work of thoroughly cleaning at least one of the incubator base 12, the wall portions 21 to 24, or the top hood 26 as needed by wiping or the like is relatively simple. Consequently, when another infant is to be accommodated in the infant accommodation space 25 in the closed type incubator 11, even if the body fluid or the like of an infant sticks to an adjacent section between the wall portions 21 to 24, and/or an adjacent section between the wall portions 21 to 24 and the top hood 26, and/or an adjacent section between the incubator base 12 and the wall portions 21 to 24 (particularly a gap between the incubator base 12 and the adjacent wall portion), it is relatively easy to thoroughly clean the gap or the like beforehand by wiping or the like. As a result, the other infant may be relatively easily prevented from being infected. Moreover, because it is relatively easy to separate the incubator base 12, the wall portions 21 to 24, and the top hood 26 from each other, when at least one of the incubator base 12, the wall portions 21 to 24, or the top hood 26 is partially or completely damaged, it suffices to repair the damaged wall portion or the like or replace the damaged wall portion or the part thereof. Therefore, work such as the replacement is relatively easy and the cost thereof may be reduced.

2. Second Embodiment

Figure 14:
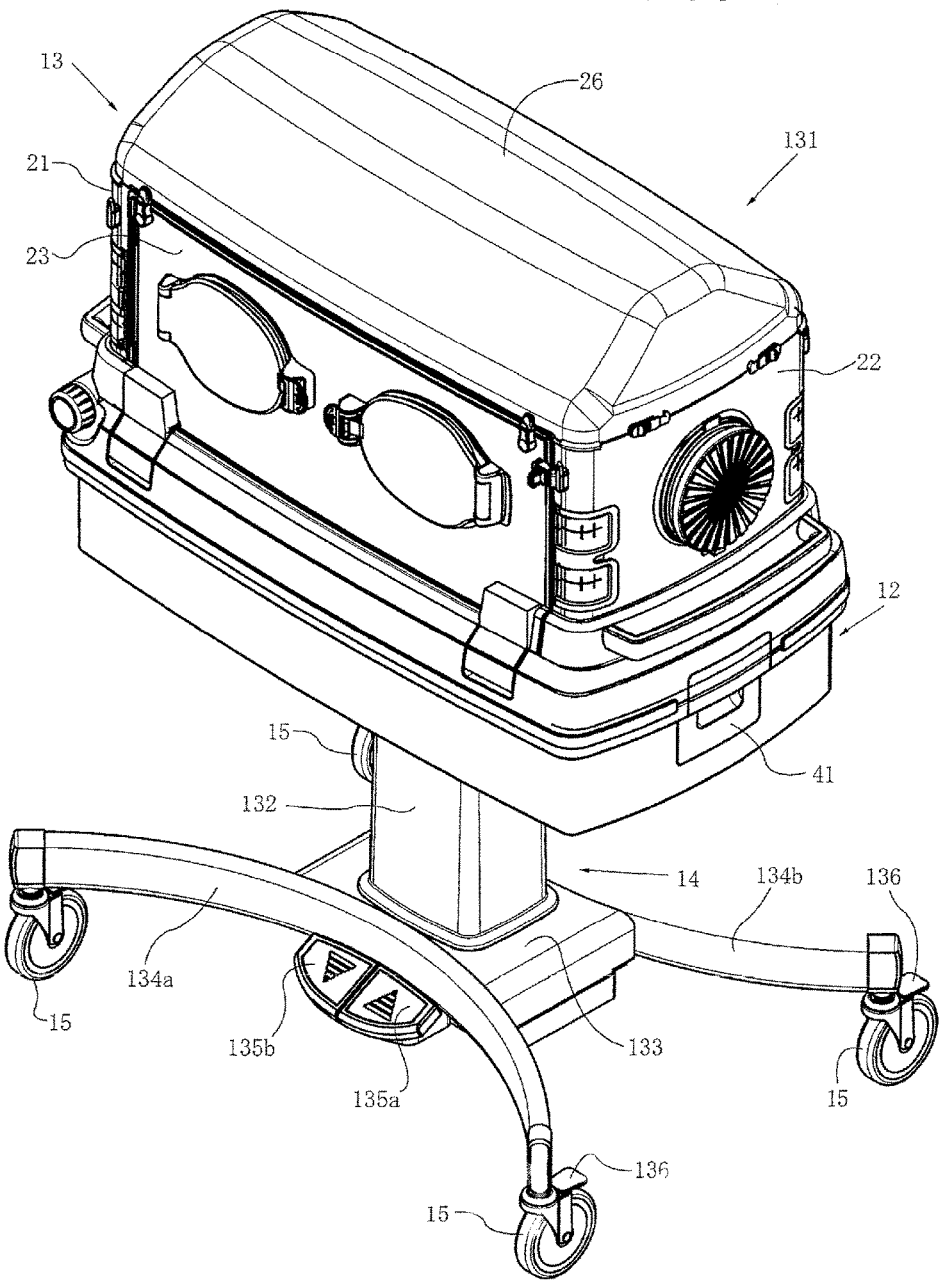
FIG. 14 is a perspective view of an incubator of a second embodiment in which the disclosure is applied to a closed type incubator.
Figure 15:
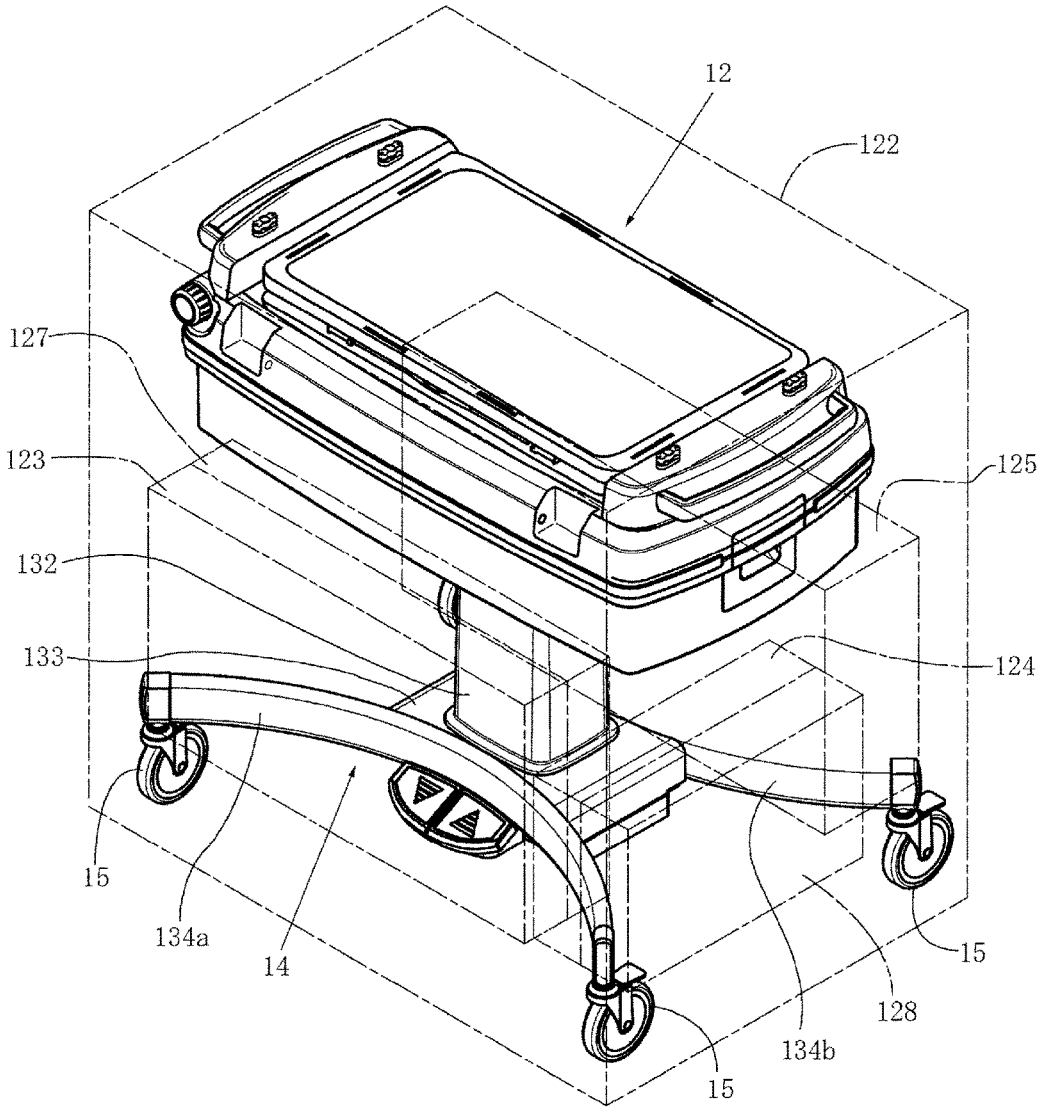
FIG. 15 is a perspective view schematically illustrating the incubator of FIG. 14, in a packed state in which the top hood, the head-side wall portion, the foot-side wall portion, the front wall portion, and the rear wall portion are individually packed and placed around the outer periphery of a strut portion, and then all the components of the incubator are packed together.

As illustrated in FIG. 14 and FIG. 15, an incubator base 12 and an enclosure 13 of a closed type incubator 131 of a second embodiment may have a similar configuration to the incubator base 12 and the enclosure 13 of the closed type incubator 11 according to the first embodiment (see FIG. 1). Consequently, specific description of the incubator base 12 and the enclosure 13 of the closed type incubator 131 will be omitted.

As illustrated in FIG. 14 and the other drawings, a trolley 14 serving as an incubator base support section or an incubator base support mechanism of the closed type incubator 131 includes a strut portion 132 having an upper end portion connected to the lower end portion of the incubator base 12, a trolley body 133 that supports the lower end portion of the strut portion 132, and a front and rear pair of substantially arc-shaped foot portions 134*a* and 134*b* that are connected to the front and rear end portions of the trolley body 133. A left and right pair of elevating/lowering pedals 135*a* and 135*b* are disposed at the substantially front section of the trolley body 133. When the operator steps on the left pedal 135*a* with his/her foot and depresses the left pedal 135*a*, the strut portion 132 extends substantially upward, and the incubator base 12 (i.e., the enclosure 13) ascends substantially upward. When the operator steps on the right pedal 135*b* with his/her foot and depresses the right pedal 135*b*, the strut portion 132 shortens substantially downward. Thereby, the incubator base 12 (and therefore the enclosure 13) descends substantially downward. Wheels 15 are attached to both the left and right side portions of each of the front and rear pair of foot portions 134*a* and 134*b*. Stoppers 136 for the operator to step on with his/her foot when stopping the individual wheels 15 from rotating are disposed at the substantially upper sides of the wheels 15.

FIG. 15 illustrates a state in which the front and rear wall portions 23 and 24, the head-side and foot-side wall portions 21 and 22, and the top hood 26 illustrated in FIG. 14 are stored in packaging containers 123 to 125, 127, and 128 as in the case illustrated in FIG. 11 and FIG. 12. That is, FIG. 15 illustrates a case in which the closed type incubator 131 illustrated in FIG. 14 is stored and packed in the packaging container 122 in a state in which the incubator 131 has been separated into the incubator base 12 having the trolley 14 attached thereto and the packaging containers 123 to 125, 127, and 128. Specifically, in order to pack the closed type incubator 131 as illustrated in FIG. 15, the four wall portions 21 to 24 and the top hood 26 configuring the enclosure 13 are individually separated from the incubator base 12 having the trolley 14 attached thereto and are packed as in the case illustrated in FIG. 11 and FIG. 12. Then, the four auxiliary wall portions 67 to 70 (see FIG. 8) may be detached from the bed base 42 and then packed together with the top hood 26, for example, as in the case illustrated in FIG. 11 and FIG. 12. Moreover, the packaging containers 123 to 125, 127, and 128 may be stored around the outer periphery of the strut portion 132 and between the incubator base 12 and the foot portions 134*a* and 134*b*, and then stored and packed in the packaging container 122 together with the incubator base 12 having the trolley 14 attached thereto.

When more than one closed type incubator 131 illustrated in FIG. 15 are each individually packed as illustrated in FIG. 15 and then simultaneously transported by the transporting means, effects that are substantially the same as those already described in the first embodiment may be achieved. According to the closed type incubator 131 illustrated in FIG. 15, as in the case of the closed type incubator 11 illustrated in FIG. 1, the work of assembling and restoring the closed type incubator 131, the work of individually separating the closed type incubator 131 into the base 12 having the trolley 14 attached thereto, the wall portions 21 to 24, and the top hood 26, and the work of cleaning, doing damage repair, and replacing parts are relatively easy.

First and second embodiments of the disclosure have been described in detail above, however, the disclosure is not limited to these embodiments and may be changed and modified in various ways on the basis of the spirit of the disclosure as defined in the claims.

For example, in the first and second embodiments, the disclosure is applied to a closed type incubator. However, the disclosure may also be applied to other incubators, such as an open type incubator doubling as a closed type incubator. In this case, a configuration may be made such that the heights of struts (not illustrated in the drawings) supporting the top hood may be increased and decreased and that the struts are detachable from the incubator base.

In the embodiments, the trolley 14 serving as the incubator base support mechanism (or the incubator base support section) is equipped with the wheels 15. However, the incubator base support mechanism 14 does not necessarily need to be equipped with the wheels 15.

In the embodiments, the incubator 11 is equipped with the trolley (i.e., the incubator base support mechanism or incubator base support section) 14. However, the incubator 11 does not necessarily need to be equipped with the incubator base support mechanism or incubator base support section 14, and the incubator base 12 of the incubator body may be mounted directly, or indirectly via a cloth or the like, on an appropriate mounting place such as an upper surface of a table or a desk.

Moreover, in the embodiments, the infant accommodation space 25 is substantially rectangular in shape when the infant accommodation space 25 is viewed in plan. However, the infant accommodation space 25 does not necessarily need to be substantially rectangular in shape when the infant accommodation space 25 is viewed in plan and, depending on the shape of the incubator base 12, for example, may also be another shape, such as substantially circular, substantially elliptical, substantially rectangular shape with semicircular ends (oval), substantially hexagonal, or substantially octagonal.

What is claimed is:

1. An incubator comprising:

an incubator base configured to support a bed base;

a peripheral frame configured to form a side closure of an infant accommodation space, the peripheral frame comprising a first wall portion, a second wall portion, a third wall portion, and a fourth wall portion all attached to the incubator base so as to surround the infant accommodation space;

a top hood configured to define an upper closure of the infant accommodation space, the top hood being detachably attached to at least one of the first, second, third and fourth wall portions;

a first latch mechanism operable to attach and detach the top hood to and from the at least one of the first, second, third and fourth wall portions, wherein the top hood is detachable from the peripheral frame by unlatching the first latch mechanism and releasing the top hood from the first latch mechanism;

second, third, fourth and fifth latch mechanisms provided, respectively, to the first wall portion, the second wall portion, the third wall portion, and the fourth wall portion to attach and detach the first, second, third and fourth wall portions to and from the incubator base, wherein each of the first, second, third and fourth wall portions is detachable from the incubator base by unlatching a corresponding latch mechanism of the second latch mechanism, the third latch mechanism, the fourth latch mechanism, and the fifth latch mechanism, and releasing the respective wall portions from the incubator base; and a movable joint provided, respectively, to at least two of the first, second, third and fourth wall portions to render the at least two of the first, second, third and fourth wall portions to be movable wall portions, which are movable with respect to the incubator base, while the movable wall portions are attached to the incubator base, whereas a rest of the at least two of the first, second, third and fourth wall portions is devoid of the movable joint to render the rest of the at least two of the first, second, third and fourth wall portions to be an immovable wall portion, which is kept from moving with respect to the incubator base while the immovable wall portion is attached to the incubator base.

2. The incubator according to claim 1, further comprising an incubator base support mechanism configured to support the incubator base.

3. The incubator according to claim 2, wherein the incubator base support mechanism comprises:

a trolley body having at least one side surface that comprises a pair of left and right doors configured to open substantially entirety of the at least one side surface or close the same; and wheels provided to the trolley body for movement of the incubator.

4. The incubator according to claim 2, wherein the incubator base support mechanism comprises:

a strut portion having an upper end portion connected to a lower end portion of the incubator base;

a trolley body that is configured to support a lower end portion of the strut portion;

a pair of foot portions both connected to opposite sides of the trolley body; and wheels that are attached to both end portions of each of the pair of foot portions.

5. The incubator according to claim 1, wherein the side closure of the infant accommodation space defines the infant accommodation space as being substantially rectangular in shape in plan view.

6. The incubator according to claim 1, wherein the top hood is detachably attached to the immovable wall portion.

7. The incubator according to claim 6, wherein the movable joints comprise a hinge operable to rotate the movable wall portions around lower ends of the movable wall portions, which are attached to the incubator base, between a substantially upright position and a substantially right downward position.

8. The incubator according to claim 1, wherein the incubator is a closed type incubator.

* * * * *